US007204110B2

(12) United States Patent
Hammar et al.

(10) Patent No.: US 7,204,110 B2
(45) Date of Patent: Apr. 17, 2007

(54) HOT DIE CLEANING SYSTEM FOR QUICK PLASTIC FORMING CELL

(75) Inventors: Richard H. Hammar, Utica, MI (US); Gary A. Kruger, Troy, MI (US); James G. Schroth, Troy, MI (US); Edward W. Bennett, Clarkston, MI (US); Curtis L. Shinabarker, Brighton, MI (US)

(73) Assignee: General Motors Corporation, Detroit, MI (US)

( * ) Notice: Subject to any disclaimer, the term of this patent is extended or adjusted under 35 U.S.C. 154(b) by 147 days.

(21) Appl. No.: 10/900,751

(22) Filed: Jul. 28, 2004

(65) Prior Publication Data

US 2006/0021408 A1 Feb. 2, 2006

(51) Int. Cl.
*B21B 45/02* (2006.01)

(52) U.S. Cl. ..... 72/40; 72/39; 72/364; 29/DIG. 96; 29/DIG. 98

(58) Field of Classification Search ..... 72/39, 72/40, 236; 29/DIG. 96, DIG. 98; 15/256.5, 15/256.52, 21.1, 160
See application file for complete search history.

(56) References Cited

U.S. PATENT DOCUMENTS

| | | | | |
|---|---|---|---|---|
| 3,379,044 | A * | 4/1968 | Albert | 72/236 |
| 3,421,172 | A * | 1/1969 | Angelo | 15/180 |
| 5,819,572 | A * | 10/1998 | Krajewski | 72/42 |
| 6,516,645 | B2 * | 2/2003 | Morales et al. | 72/53 |
| 2005/0155626 | A1 * | 7/2005 | Nordstorm et al. | 134/2 |

FOREIGN PATENT DOCUMENTS

JP 04280500 A * 10/1992

* cited by examiner

*Primary Examiner*—Dmitry Suhol
(74) *Attorney, Agent, or Firm*—Kathryn A. Marra

(57) ABSTRACT

A cleaning apparatus for removing metallic buildup from forming surfaces of metal forming dies while the dies are in a press and operating at elevated temperatures. The cleaning apparatus includes a programmable positioner having a robotic arm with an end effector carrying a brush assembly. The brush assembly includes a rotary drive motor rotatably carrying a metallic wire brush. The brush has a plurality of radially extending plain carbon steel bristles having tips adapted for removing metallic buildup from the forming surfaces of dies. The positioner operates to move the rotatable wire brush in a predetermined path that engages the brush with the forming surfaces of the dies for sweeping and cleaning metallic buildup from the forming surfaces.

4 Claims, 2 Drawing Sheets

HOT DIE CLEANING SYSTEM FOR QUICK PLASTIC FORMING CELL

TECHNICAL FIELD

This invention relates to the art of cleaning hot forming dies and, more particularly, to new and improved processes for the rapid and contaminate-free cleaning of metallic buildup from hot working surfaces of quick plastic forming dies to enhance the production of formed sheet metal parts with high quality show surfaces.

BACKGROUND OF THE INVENTION

Super plastic and quick plastic forming techniques employ equipment in which a ductile metal blank of suitable metallic material is heated and stretched between forming surfaces of a pair of hot dies to create a formed panel of a desired shape. As the blank is stretched between the forming surfaces of the dies, metal particles from the blank may collect on the forming surfaces of the dies. Over time, the accumulation of metal particles on the forming surfaces of the dies may cause indentations and other irregularities to occur on the show surfaces of the formed panel requiring the panel to be scrapped or manually repaired.

Current methods of removing such metallic buildup require the dies to be cooled to room temperature and manually sanded, resulting in production downtime.

SUMMARY OF THE INVENTION

The present invention provides a cleaning apparatus operative to remove metallic buildup from forming surfaces of heated forming dies while the dies are operatively mounted in a press and movable between open and closed positions to minimize production downtime.

The cleaning apparatus includes a programmable positioner programmed to move a rotating brush along forming surfaces of forming dies. The positioner includes a robotic arm extending from a base. The arm has an end effector carrying a brush assembly including a rotary drive motor, such as an electric or air driven motor operable to rotate a cylindrical wire brush at rotational speeds greater than 1000 rpm or a circumferential surface speed of at least 5 feet per second.

In an exemplary embodiment, the wire brush has a 6 inch diameter and extends axially between 1 and 6 inches. The brush has a plurality of wire bristles, formed of low carbon steel extending radially to the outer diameter of the brush. Each bristle wire has a cross-sectional diameter of less than 0.015 inches and a tip having a sharp edge (not rounded) or a point to maximize the ability of the brush to remove metal particles from the forming surfaces of the dies.

These and other features and advantages of the invention will be more fully understood from the following description of certain specific embodiments of the invention taken together with the accompanying drawings.

DESCRIPTION OF THE PREFERRED EMBODIMENT

Figure 1:
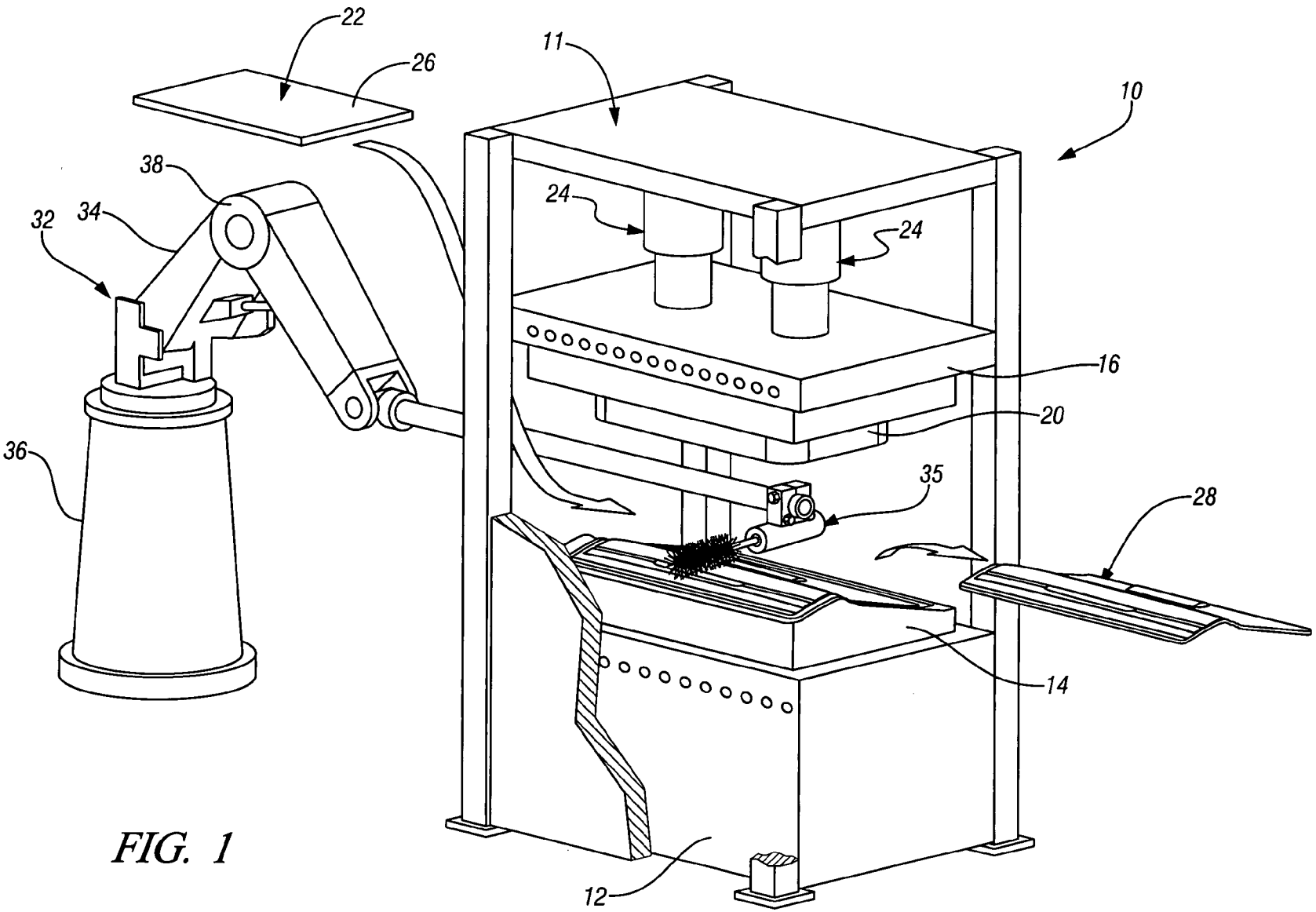
FIG. 1 is a pictorial view of an opened forming press with forming dies to be cleaned by a cleaning apparatus according to the present invention.

Referring first to FIG. 1 of the drawings in detail, numeral 10 generally indicates a panel forming workstation including a forming press 11. Press 11 includes a lower bolster plate 12 on which a lower steel forming die 14 is mounted, and a reciprocating ram plate 16, which carries an upper steel forming die 20. Both of the plates 12, 20 are electrically heated to establish required heat energy levels in the die and sheet metal blanks 22 for superplastic forming or quick plastic forming as is known in the art. If desired, the metal blanks 22 may be preheated before being loaded into the press 11.

The ram plate 16 is moved by hydraulic cylinders 24 to cycle the ram plate from an open position for blank loading to a closed blank forming position and then back to the open position shown in FIG. 1 for formed part removal.

The blanks 22 utilized with one preferred embodiment of this invention are flattened sheets of aluminum alloy coated with a dry lubricant 26 such as boron nitride. The lubricant 26 functions as a release agent to prevent the formed panel 28 from sticking to the forming dies 14, 20 and to enhance the stretching and formation of the part during the forming operation.

If desired, optional $CO_2$ cleaning equipment, as shown for example in patent U.S. Pat. No. 6,516,645, may be intermittently used to eliminate accumulations of lubricant collected on the forming surfaces of the dies 14, 20.

The present invention provides cleaning apparatus 32, which includes a programmable positioner in the form of a robot 34 and a brush assembly 35. If appropriate, any other suitable form of programmable positioner may be substituted for the robot within the scope of the invention.

Figure 2:
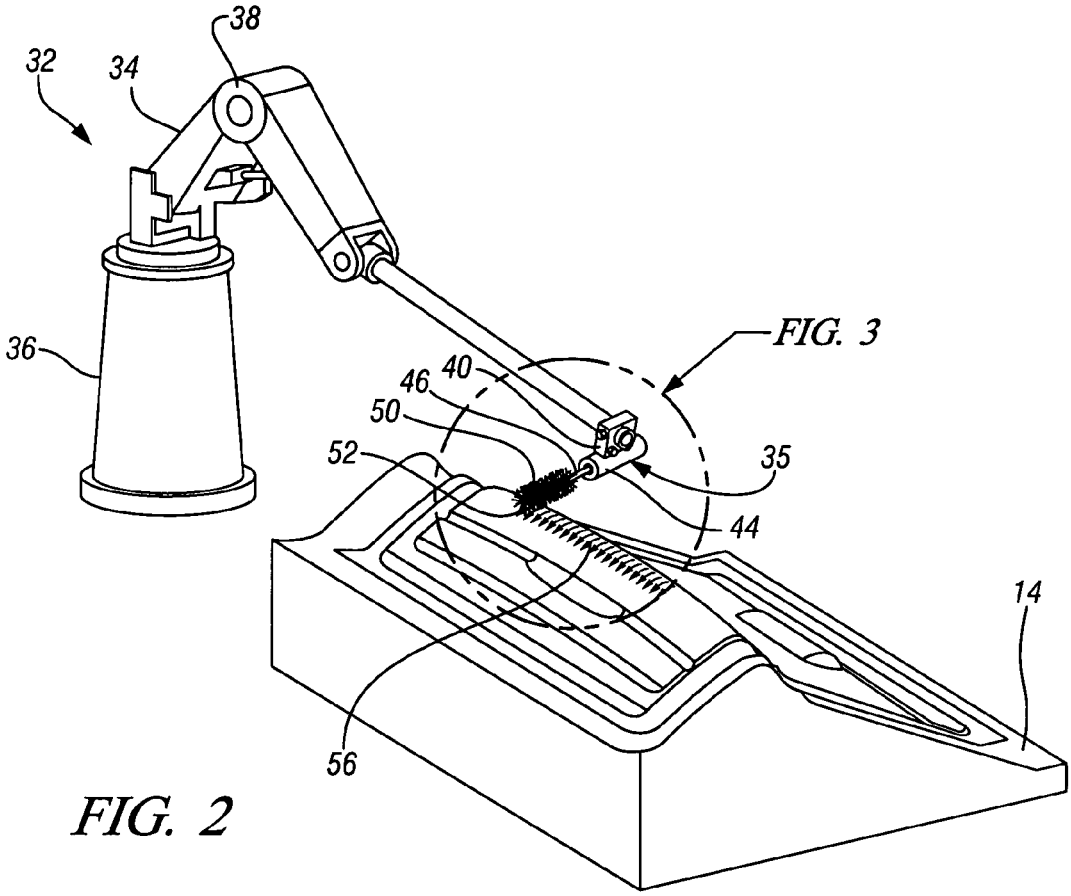
FIG. 2 is a pictorial view of the cleaning apparatus and a die of FIG. 1. with the surrounding forming press removed.
Figure 3:
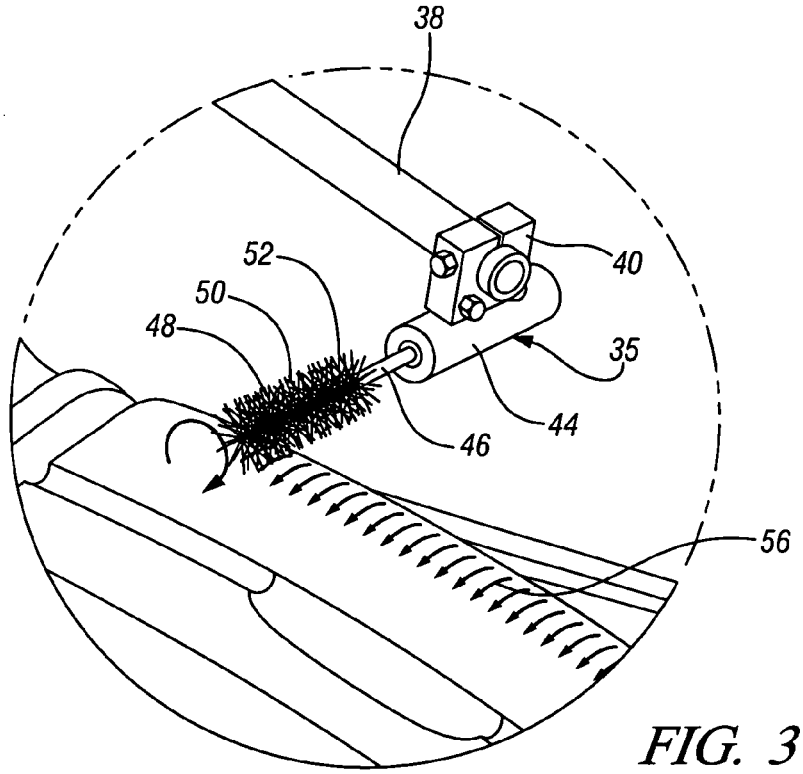
FIG. 3 is an enlarged view showing brush rotation across the direction of metallic particle lines on the surface of a forming die.

The robot 34 includes a base 36 supporting a jointed arm 38 with an end effector or holder 40 carrying the brush assembly 35, best shown in FIGS. 2 and 3. Brush assembly 35 includes a rotary drive motor 44, which may be of any suitable type, such as electric or fluid driven. An air motor is preferred at present since the driving air helps cool the motor. The drive motor 44 has an axially extending drive shaft 46 with a distal end carrying a cylindrical brush 48. The brush 48 has a plurality of radially extending plain carbon steel metallic wire bristles 50 having tips that are sharp edged or pointed. When the tips become rounded, the cleaning action is less effective for removing metallic buildup from the forming surfaces of the dies 14, 20. The bristles 50 may also be formed of higher carbon steel so long as the hardness of the bristles is less than that of the die material.

In an exemplary embodiment, the brush has a 6 inch diameter and is approximately 1 to 2 inches in length with low carbon steel bristles. The bristles have a cross-sectional diameter of approximately 0.006 inches. However, the brush and bristles may range in length and diameter depending upon the hardness of the bristles and the application.

In operation, metal blanks 22 are serially loaded into the press 11 and formed by the dies 14, 20. During the forming process, quantities of dry lubricant and other foreign matter, such as metallic particles 56 from the metal blanks 22, accumulate on the forming surfaces of the dies 14, 20. The build-up of metallic particles is diagrammatically illustrated in FIG. 3. As shown in FIG. 3, arrows 56 illustrate the formation of the metallic particles, which tend to form in a single direction, parallel to the direction of metal flow during forming of the metal blanks 22.

To prevent the buildup of lubricants on the forming surfaces of the dies 14, 20, a $CO_2$ cleaning device periodically sprays cylindrical pellets of $CO_2$ (dry ice) over the forming surfaces of the dies, in a predetermined pattern, to remove lubricants from the forming surfaces of the dies. The removal of the lubricants prevents surface flaws or imperfections in the form of dimples, streaks or other blemishes formed on the formed panels 28. Since the $CO_2$ cleaning device is unable to remove metallic particles from the forming surfaces of the dies 14, 20, cleaning apparatus 32 removes any remaining metallic particles.

Cleaning apparatus 32 operates by initially activating the drive motor 44 to rotate brush 48 at a cleaning speed of approximately 1,000 RPM. The robot 34 then moves the brush 48 into engagement with the forming surface of the lower forming die 14. As the tips 52 of the bristles 50 contact the forming surface of the die 14, the sharp tips or edges gently scrape the forming surface to remove any metallic buildup indicated by arrows 56. The robot 34 then moves the brush 48 in a predetermined path, along the forming surface of the die 14, to remove the metallic buildup. Preferably, the robot 34 moves the brush 48, so that the brush 48 rotates perpendicular to the arrows 56 or the forming direction of the metallic particles to maximize the removal of metallic particles from the forming surface. After the lower forming die is cleaned, the upper forming die 20 is cleaned by the cleaning apparatus in a similar manner.

After the cleaning operation is complete, the robot 34 withdraws the cleaning apparatus from the forming press 10 to allow resumption of the serial forming of blanks 22 into panels 28.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. A method of super plastic and quick plastic forming sheet metal parts which are substantially free of show surface imperfection comprising the steps of:

heating at least one metal forming die to a predetermined temperature range;

inserting a blank of lubricated metal stock onto a forming surface of the die;

forcing the blank onto the forming die to form a panel;

removing the formed panel from the forming die;

removing metallic buildup from the forming surface of the die using a cleaning apparatus comprising a programmable positioner carrying a brush assembly including a rotary drive motor rotatably carrying a cylindrical brush, the brush having a plurality of radially extending metallic wire bristles spaced axially from the rotary drive motor and adapted for removing metallic buildup from the forming surface of the forming die; and moving the cylindrical brush with the programmable positioner along a predetermined cleaning path with the brush in engagement with the forming surface of the die to remove metallic buildup therefrom;

wherein the metallic buildup is deposited generally in a predetermined direction on the forming die and the brush is rotated generally perpendicular to the direction of metallic buildup.

2. A method as in claim 1 wherein:

the metal forming die has a steel-forming surface, the lubricated metal stock is an aluminum alloy suitable for the forming method, the bristles of the wire brush are of steel softer than the forming surface of the die, and the metallic buildup is primarily aluminum alloy from the metal stock.

3. A method as in claim 1 wherein the predetermined cleaning path lies generally perpendicular to the direction of metallic buildup.

4. A method as in claim 3 wherein the rotary drive motor is air driven.

* * * * *